US007430381B2

(12) United States Patent
Takenouchi et al.

(10) Patent No.: US 7,430,381 B2
(45) Date of Patent: Sep. 30, 2008

(54) DEVELOPING DEVICE WITH CORRECTED TONER DENSITY SENSING, CONTROL METHOD, AND COMPUTER-READABLE STORAGE MEDIUM

(75) Inventors: Kouichi Takenouchi, Tenri (JP); Mitsuru Tokuyama, Soraku-gun (JP); Hiroo Naoi, Nara (JP); Kiyofumi Morimoto, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 225 days.

(21) Appl. No.: 11/362,508

(22) Filed: Feb. 27, 2006

(65) Prior Publication Data

US 2006/0193650 A1 Aug. 31, 2006

(30) Foreign Application Priority Data

Feb. 28, 2005 (JP) ..... 2005-054794
Feb. 24, 2006 (JP) ..... 2006-049367

(51) Int. Cl.
*G03G 15/06* (2006.01)

(52) U.S. Cl. ..... 399/55

(58) Field of Classification Search ..... 399/55, 399/44, 27, 58, 59
See application file for complete search history.

(56) References Cited

U.S. PATENT DOCUMENTS 4,647,185 A * 3/1987 Takeda et al. ..... 399/27
5,214,475 A * 5/1993 Ishii et al. ..... 399/27
5,311,261 A 5/1994 Nakagama et al.

FOREIGN PATENT DOCUMENTS

| | | | |
|---|---|---|---|
| JP | 59176765 A | * | 10/1984 |
| JP | 4-44066 | | 2/1992 |
| JP | 5-61353 A | | 3/1993 |
| JP | 5-107924 A | | 4/1993 |
| JP | 8-87168 | | 4/1996 |
| JP | 2002-72660 | | 3/2002 |
| JP | 2004020614 A | * | 1/2004 |
| JP | 2004-53744 | | 2/2004 |
| JP | 2004-240111 A | | 8/2004 |

* cited by examiner

*Primary Examiner*—Susan S Lee
(74) *Attorney, Agent, or Firm*—Nixon & Vanderhye, P.C.

(57) ABSTRACT

The developing device according to the present invention includes a developing tank for containing two-component developer, a toner density sensor, and a toner cartridge. Further, the developing device according to the present invention includes a control section for inputting, to the toner density sensor, a control voltage (Vc) for correcting a sensor output. The control section sets the control voltage (Vc), by using a standard control voltage having been set so as to correspond to each of the stirring velocities, so that a sensor output (Vo) has a value within a range indicative of predetermined toner density. With the arrangement, it is possible to set the toner density sensor so that the toner density sensor operates in the most suitable manner so as to correspond to each of the stirring velocities, thereby realizing a developing device capable of detecting toner density with high accuracy.

10 Claims, 11 Drawing Sheets

FIG. 11

RELATIVE HUMIDITY

| | HUMIDITY IN INITIAL ADJUSTMENT Hdo % | | | | | | | | | | | | | | |
|---|---|---|---|---|---|---|---|---|---|---|---|---|---|---|---|
| HUMIDITY HD % | >10 | 10~15 | 15~20 | 20~25 | 25~30 | 30~35 | 35~40 | 40~45 | 50~55 | 55~60 | 60~65 | 65~70 | 70~75 | 75~80 | 80≦ |
| >10 | 0 | 0 | 0.05 | 0.10 | 0.15 | 0.20 | 0.25 | 0.30 | 0.35 | 0.40 | 0.40 | 0.40 | 0.40 | 0.40 | 0.40 |
| 10~15 | 0 | 0 | 0 | 0.05 | 0.10 | 0.15 | 0.20 | 0.25 | 0.30 | 0.35 | 0.40 | 0.40 | 0.40 | 0.40 | 0.40 |
| 15~20 | -0.05 | 0 | 0 | 0 | 0.05 | 0.10 | 0.15 | 0.20 | 0.25 | 0.30 | 0.35 | 0.40 | 0.45 | 0.40 | 0.40 |
| 20~25 | -0.10 | -0.05 | 0 | 0 | 0 | 0.05 | 0.10 | 0.15 | 0.20 | 0.25 | 0.30 | 0.35 | 0.40 | 0.40 | 0.40 |
| 25~30 | -0.15 | -0.10 | -0.05 | 0 | 0 | 0 | 0.05 | 0.10 | 0.15 | 0.20 | 0.25 | 0.30 | 0.35 | 0.40 | 0.40 |
| 30~35 | -0.20 | -0.15 | -0.10 | -0.05 | 0 | 0 | 0 | 0.05 | 0.10 | 0.15 | 0.20 | 0.25 | 0.30 | 0.35 | 0.40 |
| 35~40 | -0.25 | -0.20 | -0.15 | -0.10 | -0.05 | 0 | 0 | 0 | 0.05 | 0.10 | 0.15 | 0.20 | 0.25 | 0.30 | 0.35 |
| 40~45 | -0.30 | -0.25 | -0.20 | -0.15 | -0.10 | -0.05 | 0 | 0 | 0 | 0.05 | 0.10 | 0.15 | 0.20 | 0.25 | 0.30 |
| 50~55 | -0.35 | -0.30 | -0.25 | -0.20 | -0.15 | -0.10 | -0.05 | 0 | 0 | 0 | 0.05 | 0.10 | 0.15 | 0.20 | 0.25 |
| 55~60 | -0.40 | -0.35 | -0.30 | -0.25 | -0.20 | -0.15 | -0.10 | -0.05 | 0 | 0 | 0 | 0.05 | 0.10 | 0.15 | 0.20 |
| 60~65 | -0.40 | -0.40 | -0.35 | -0.30 | -0.25 | -0.20 | -0.15 | -0.10 | -0.05 | 0 | 0 | 0 | 0.05 | 0.10 | 0.15 |
| 65~70 | -0.40 | -0.40 | -0.40 | -0.35 | -0.30 | -0.25 | -0.20 | -0.15 | -0.10 | -0.05 | 0 | 0 | 0 | 0.05 | 0.10 |
| 70~75 | -0.40 | -0.40 | -0.40 | -0.40 | -0.35 | -0.30 | -0.25 | -0.20 | -0.15 | -0.10 | -0.05 | 0 | 0 | 0 | 0.05 |
| 75~80 | -0.40 | -0.40 | -0.40 | -0.40 | -0.40 | -0.35 | -0.30 | -0.25 | -0.20 | -0.15 | -0.10 | -0.05 | 0 | 0 | 0 |
| 80≦ | -0.40 | -0.40 | -0.40 | -0.40 | -0.40 | -0.40 | -0.35 | -0.30 | -0.25 | -0.20 | -0.15 | -0.10 | -0.05 | 0 | 0 |

DEVELOPING DEVICE WITH CORRECTED TONER DENSITY SENSING, CONTROL METHOD, AND COMPUTER-READABLE STORAGE MEDIUM

This non-provisional application claims priority under 35 U.S.C. §119(a) on Patent Application No. 2005-054794 filed in Japan on Feb. 28, 2005 and Patent Application No. 2006-049367 filed in Japan on Feb. 24, 2006, the entire contents of which are hereby incorporated by reference.

FIELD OF THE INVENTION

The present invention relates to: a developing device that adjusts a toner density sensor in performing development using two-component developer; and an image forming apparatus having the developing device.

BACKGROUND OF THE INVENTION

An image forming apparatus based on electrophotography, such as a copying machine, a facsimile, a printer, and the like, uses two-component developer. The two-component developer is constituted of toner (dye powder) and carrier (magnetic powder) and is contained in a developing tank. Only toner out of the two-component developer is used to form an image. In order to obtain a clear image in a stable condition by using the two-component developer, it is important always to maintain a mixing ratio of components in the best condition. Therefore, this type of image forming apparatus is provided with a toner density sensor by which the mixing ratio of components is maintained in a constant value. Toner is supplied from a toner cartridge to the developing tank according to an amount of toner consumption.

For example, Patent Document 1: Japanese Unexamined Patent Publication 44066/1992 (Tokukaihei 4-44066) (published on Feb. 13, 1992) discloses an image forming apparatus that detects toner density in changing developer, and controls (corrects) toner density so that the detected value is set as standard toner density.

In general, an image forming apparatus includes a plurality of printing modes different from each other in a printing velocity. In these printing modes, the printing velocity is changed by changing the number of rotation of a photoconductor drum and process velocity. As a result, stirring velocity of two-component developer contained in a developing tank changes according to the printing modes.

However, the image forming apparatus disclosed in Patent Document 1 performs the same toner density control when the printing mode (printing velocity) changes. As a result, it is impossible to detect toner density with high accuracy, so that it is impossible to stably supply toner to the developing tank.

Patent Document 2: Japanese Unexamined Patent Publication 72660/2002 (Tokukai 2002-72660) (published on Mar. 12, 2002) discloses an image forming apparatus in which an input voltage of a toner density sensor is set to many values according to toner densities. With the arrangement, the input voltage is varied (switched) according to the printing velocity and toner density, so as to realize detection of toner density with high accuracy.

However, toner density control with high accuracy cannot be performed only by switching input voltages corresponding to the printing velocities, as described in Patent Document 2.

Namely, the image forming apparatus disclosed in Patent Document 2 adjusts the toner density sensor by using typical printing velocity out of the printing velocities. However, it is proved that when an image is formed at printing velocity different from printing velocity used in adjustment, detection of toner density with high accuracy cannot be maintained.

SUMMARY OF THE INVENTION

The present invention was made in view of the foregoing problems, and its object is to provide: a developing device that can set a toner density sensor so that the toner density sensor operates in the most suitable manner with respect to each of a plurality of printing velocities (stirring velocities) so as to realize detection of toner density with high accuracy; an image forming apparatus including the developing device; and an adjusting method for adjusting a toner density sensor that allows detection of toner density with high accuracy.

In order to achieve the object, the developing device according to the present invention includes: a developing tank for containing two-component developer including toner and carrier and for stirring the two-component developer at a plurality of stirring velocities; a toner density sensor for detecting toner density in the developing tank; a toner supply section for supplying toner to the developing tank; and a control section for inputting, to the toner density sensor, a control voltage for correcting a sensor output that is outputted from the toner density sensor, wherein the control section sets a standard control voltage for correcting a sensor output obtained by sensing density of two-component developer having standard toner density having been set to a certain value so that the sensor output corresponds to each of the stirring velocities, and the control section sets the control voltage by use of the standard control voltage so that the sensor output has a value within a range indicative of predetermined toner density so as to correspond to each of the stirring velocities.

The developing device uses two-component developer including toner and carrier. In the developing device, the toner density sensor detects toner density of two-component developer contained in the developing tank. In the developing tank, only toner is used for development processing. Therefore, the developing device supplies toner from the toner supply section to the developing tank when the toner density sensor detects that toner density is not more than a predetermined value.

The developing tank causes a mixing condition of toner and carrier included in two-component developer to be even and stirs the two-component developer so that the toner is charged. Normally, a plurality of stirring speeds are set for the developing tank. However, even when two-component developer having same toner density is used, an amount of charge and apparent bulk density change due to a difference in stirring velocities in the developing tank. As a result, the toner density sensor outputs sensor outputs having different toner density even when real toner density has a same value. Therefore, when a sensor output of the toner density sensor is corrected (detection characteristic is set to be constant) regardless of stirring velocity, detection range of the toner density sensor become narrow and accordingly detection accuracy drops.

With the arrangement, the control section first sets a standard control voltage for correcting a sensor output, with respect to each of the plurality of stirring velocities, by using two-component developer having standard toner density. Then, the control section uses each of the standard control voltages having been set with respect to each of the stirring velocities, so as to set a control voltage with respect to each of the stirring velocities.

As described above, with the arrangement, a plurality of standard control voltages respectively corresponding to stirring velocities are set and control voltages corresponding to the stirring velocities are set by using the standard control voltages. As a result, according to stirring velocity at which actual development processing is performed, the output of the toner density sensor in the stirring velocity can be corrected (adjusted). Therefore, the toner density sensor can be set so as to operate in the most suitable manner with respect to each of the stirring velocities, thereby realizing detection of toner density with high accuracy.

For a fuller understanding of the nature and advantages of the invention, reference should be made to the ensuing detailed description taken in conjunction with the accompanying drawings.

BRIEF DESCRIPTION OF THE DRAWINGS

FIG. 11 illustrates a humidity correction table in the developing device according to the present invention.

DESCRIPTION OF THE EMBODIMENTS

An embodiment according to the present invention is explained below with reference to FIGS. 1 through 13.

An image forming apparatus according to the present invention automatically adjusts an output of a toner density sensor based on printing velocity and humidity. The following serially explains (i) the structure of the image forming apparatus including a developing device according to the present invention and (ii) the developing device which is a feature of the present invention.

(1) Structure of Image Forming Apparatus

Figure 12:
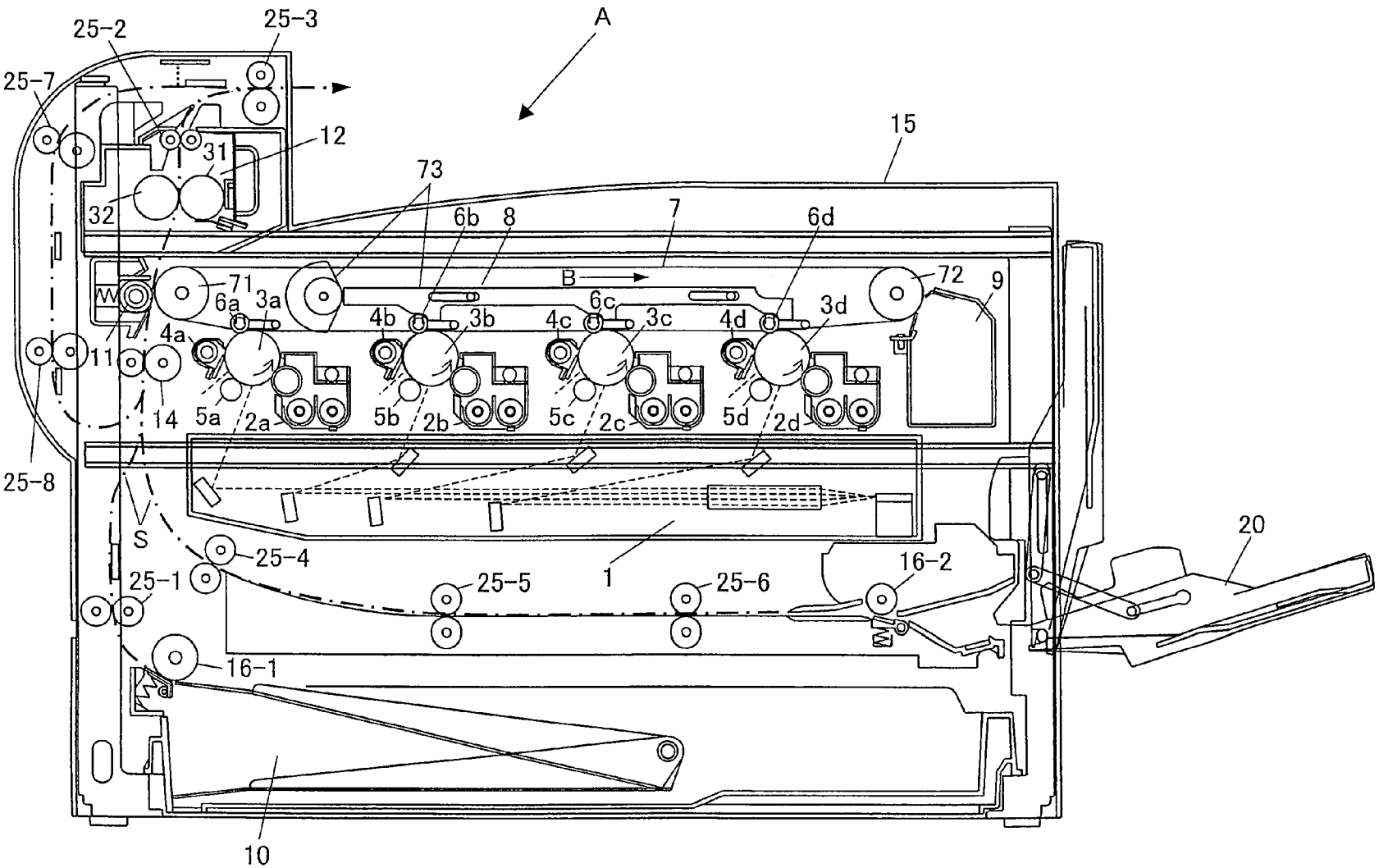
FIG. 12 is a cross sectional view illustrating the image forming apparatus including the developing device according to the present invention at a time when a toner bottle is not attached to the image forming apparatus.
Figure 13:
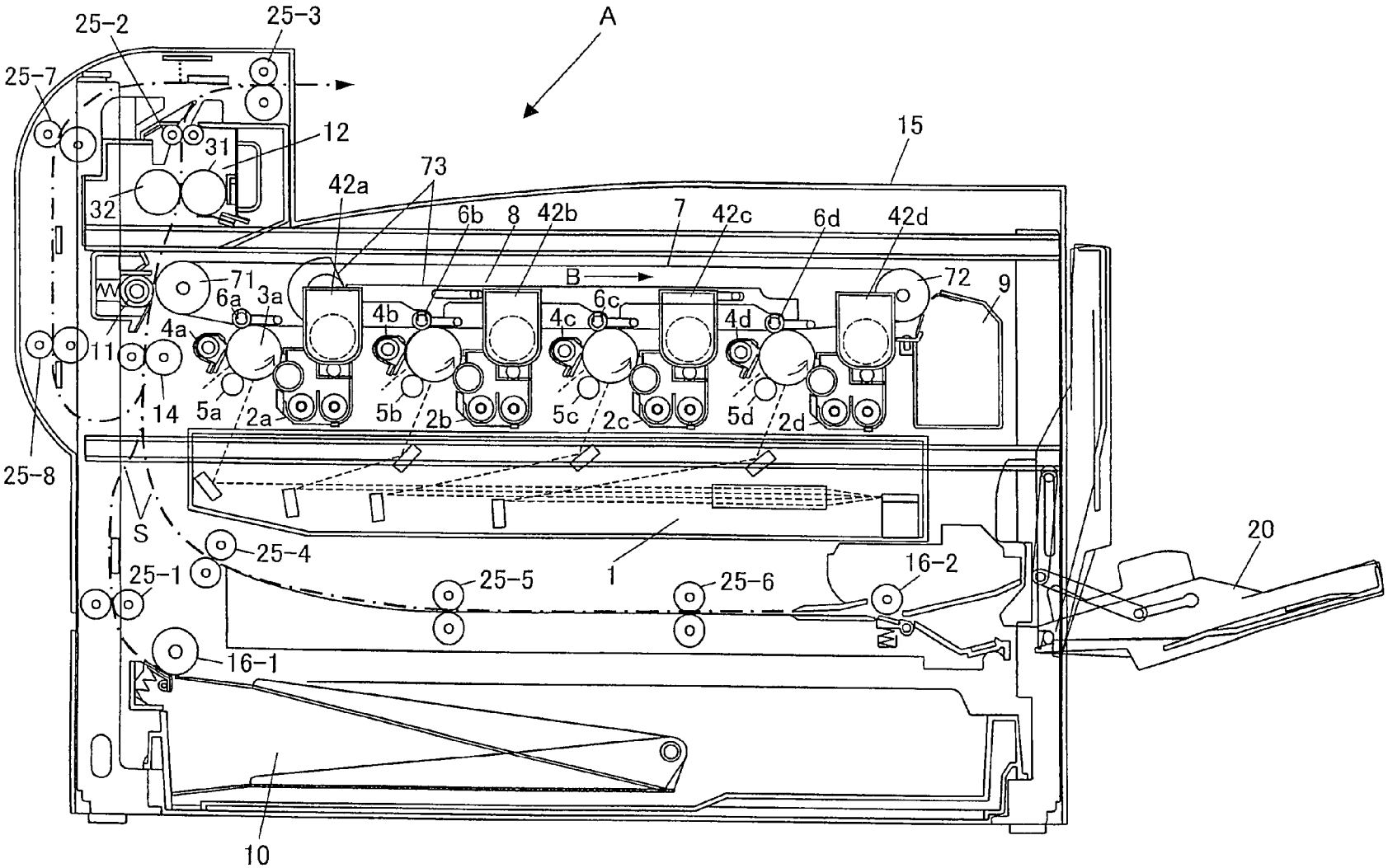
FIG. 13 is a cross sectional view illustrating the image forming apparatus including the developing device according to the present invention at a time when the toner bottle is attached to the image forming apparatus.

First, the structure of the image forming apparatus including the developing device according to the present invention is explained. FIGS. 12 and 13 are cross sectional views schematically illustrating the structure of an image forming apparatus A according to the present invention. The image forming apparatus A forms an image by using two-component developer. Further, the image forming apparatus A includes toner cartridges (toner bottles, toner supply sections) 42 (42*a* through 42*d*) that are detachable from the image forming apparatus A. FIG. 12 illustrates a state in which the toner cartridges 42 are detached, and FIG. 13 illustrates a state in which the toner cartridges 42 are attached.

The image forming apparatus A forms a multi-colored or simple-colored image on a predetermined sheet (recording paper) based on image data.

The image forming apparatus A forms a multi-colored or simple-colored image on a predetermined sheet (recording paper) based on image data transmitted from an outside. As illustrated in FIGS. 12 and 13, the image forming apparatus A includes an exposure unit 1, developing tanks 2 (2*a*, 2*b*, 2*c*, and 2*d*), photoconductor drums 3 (3*a*, 3*b*, 3*c*, and 3*d*), chargers 5 (5*a*, 5*b*, 5*c*, and 5*d*), cleaner units 4 (4*a*, 4*b*, 4*c*, and 4*d*), an intermediate transfer belt unit 8, a fixing unit 12, a paper convey route S, a sheet feeding cassette 10, a sheet delivery tray 15, and the like.

Note that image data dealt with in the image forming apparatus A corresponds to a color image using black (K), cyan (C), magenta (M), and yellow (Y). Therefore, the developing tanks 2 (2*a*, 2*b*, 2*c*, and 2*d*), the photoconductor drums 3 (3*a*, 3*b*, 3*c*, and 3*d*), the cleaner units 4 (4*a*, 4*b*, 4*c*, and 4*d*), and the chargers 5 (5*a*, 5*b*, 5*c*, and 5*d*) are respectively provided as many as four so as to form four kinds of latent images corresponding to four colors. a, b, c, and d are set to black, cyan, magenta, and yellow, respectively, thereby constituting four image units.

The photoconductor drums 3 are disposed (attached) in an upper part of the image forming apparatus A.

The chargers 5 are charging means for charging surfaces of the photoconductor drums 3 evenly with a predetermined voltage. Examples of the chargers 5 include not only a contact type charger such as a roller-type or a brush-type as illustrated in FIGS. 12 and 13, but also a non-contact type charger.

Examples of the exposure unit 1 include: not only a method in which a laser scanning unit (LSU) including a laser emitting section and a reflecting mirror illustrated in FIGS. 12 and 13 is used; but also a method in which EL (electro luminescence) or LED (light emitting diode) writing head having light-emitting devices arrayed is used. The exposure unit 1 exposes the charged photoconductor drums 3 based on input image data so as to form, on the surfaces of the photoconductor drums 3, electrostatic latent images based on the image data.

The developing tanks 2 visualize the latent images formed on each of the photoconductor drums 3 by using toners with respective colors (K, C, M, and Y). In the image forming apparatus A, two-component developer is contained in the developer tanks 2 so that an image is formed by using two-component developer. The developer tanks 2 are provided with the toner cartridges 42 (42*a*, 42*b*, 42*c*, and 42*d*) for supplying toner to the developing tanks 2. The developing tanks 2 and the toner cartridges 42 constitute the developing device. The developing device is explained later.

The cleaner units 4 remove and collect toner remaining on the surfaces of the photoconductor drums 3 after development/image-transfer.

An intermediate transfer belt unit 8 disposed above the photoconductor drums 3 includes an intermediate transfer belt 7, an intermediate transfer belt driving roller 71, an intermediate transfer belt tension mechanism 73, an intermediate transfer belt driven roller 72, an intermediate transfer rollers 6 (6*a*, 6*b*, 6*c*, and 6*d*), and an intermediate transfer belt cleaning unit 9.

The intermediate transfer belt driving roller 71, the intermediate transfer belt tension mechanism 73, the intermediate transfer rollers 6, the intermediate transfer belt driven roller 72, and the like elongate and drive the intermediate transfer belt 7 so that the intermediate transfer belt 7 rotates in a direction of an arrow B.

The intermediate transfer rollers 6 are supported by an intermediate transfer roller attaching section of the intermediate transfer belt tension mechanism 73 so as to be rotatable. The intermediate transfer rollers 6 give a transfer bias for transferring toner images of the photoconductor drums 3 onto the intermediate transfer belt 7.

The intermediate transfer belt 7 is disposed so as to be in contact with each of the photoconductor drums 3. Toner images with respective colors, formed on the photoconductor drums 3, are serially superimposed and transferred onto the intermediate transfer belt 7 so that a colored toner image (multi-colored toner image) is formed. The intermediate transfer belt 7 is made of a film whose thickness is 100 through 150 μm so as to be endless.

A toner image is transferred from the photoconductor drums 3 onto the intermediate transfer belt 7 by the intermediate transfer rollers 6 that are in contact with an underside of the intermediate transfer belt 7. A transfer bias having a high voltage (high voltage having a polarity (+) opposite to a charging polarity (−) of toner) is applied to the intermediate transfer rollers 6 so that the intermediate transfer rollers 6 transfer the toner image. Each of the intermediate transfer rollers 6 is constituted of (i) a metal (e.g. stainless steel), whose diameter is 8 through 10 mm, provided as a base and (ii) a conductive elastic member (e.g. EPDM or urethane form) covering around the base. It is possible to evenly apply a high voltage to the intermediate belt 7 by using the conductive elastic member. The present example uses a roller-shaped transfer electrode. Besides, a brush-shaped transfer electrode and the like can be used as a transfer electrode.

As described above, electrostatic images having been visualized according to each hue on each of the photoconductor drums 3 are laminated by the intermediate transfer belt 7 and become image information as inputted to the image forming apparatus A.

In this way, the laminated image information is conveyed by rotation of the intermediate transfer belt 7 and transferred onto a later-mentioned paper by the transfer roller 11 disposed at a portion where the intermediate transfer belt 7 is in contact with the paper.

At that time, the intermediate transfer belt 7 is pressed to the transfer roller 11 with a predetermined nip, and a voltage (transfer voltage) for transferring toner onto a paper is applied to the transfer roller 11 (high voltage whose polarity (+) is opposite to a charging polarity (−) of toner). Further, in order to obtain the predetermined nip, one of the transfer roller 11 and the intermediate transfer belt driving roller 71 is a hard material (such as metal) and the other is a soft material (such as an elastic rubber roller or expandable resin roller).

Further, mixture of colors is caused in the next step by (i) toner attached to the intermediate transfer belt 7 due to contact with the photoconductor drums 3 or (ii) toner remaining on the intermediate transfer belt 7 because the transfer roller 11 did not transfer an image on a paper. Therefore, the attaching toner or remaining toner is removed and collected by the intermediate transfer belt cleaning unit 9. The intermediate transfer belt cleaning unit 9 includes a cleaning blade provided as a cleaning member for contacting with the intermediate transfer belt 7. A portion of the intermediate transfer belt 7 which is in contact with the cleaning blade is supported by the intermediate transfer belt driven roller 72 from the underside.

The sheet feeding cassette 10 is used to store sheets (recording papers) on which images are to be formed, and is disposed under an image forming section of the image forming apparatus A and the exposure unit 1. Further, the sheet delivery tray 15 disposed in the upper part of the image forming apparatus A is used to place printed sheets so that printed sides of the sheets face downward.

Further, the image forming apparatus A includes the paper convey route S having a substantially vertical shape, which is used to convey a sheet in the sheet feeding cassette 10 to the sheet delivery tray 15 via the transfer roller 11 and the fixing unit 12. Further, pickup rollers 16, a resist roller 14, the transfer roller 11, the fixing unit 12, convey rollers 25 for conveying a sheet, and the like are provided in the vicinity of the paper convey route S extending from the sheet feeding cassette 10 to the sheet delivery tray 15.

The convey rollers 25 are small rollers used to prompt/assist conveyance of a sheet and are provided along the paper convey route S. The pickup rollers 16 are disposed at an end of the sheet feeding cassette 10 and serve as attracting rollers for supplying a sheet to the paper convey route S.

Further, the resist roller 14 temporarily holds a sheet conveyed through the paper convey route S. The resist roller 14 conveys a sheet to the convey roller 11 at a timing which allows ends of toner images on the photoconductor drums 3 to overlap with an end of a sheet.

The fixing unit 12 includes a heat roller 31, a pressure roller 32, and the like. The heat roller 31 and the pressure roller 32 rotate so that the former and the latter put a sheet therebetween.

Further, the heat roller 31 is set by a control section so as to have a predetermined fixing temperature based on a signal from a temperature detection device (not shown). The heat roller 31 performs thermo compression of a sheet in collaboration with the pressure roller 32 so as to cause a multi-colored toner image transferred onto the sheet to be fused/mixed/pressed, thereby fixing the multi-colored toner image onto the sheet.

Note that the sheet to which the multi-colored toner image has been fixed is conveyed to an inverse sheet delivery route of the paper convey route S by the convey rollers 25, and delivered onto the sheet delivery tray 15 so as to be in an inverted condition (so that the multi-colored toner image faces downward).

Next, a sheet convey route is detailed. The present image forming apparatus is provided with the sheet feeding cassette 10 that stores sheets in advance, and a manual feeding tray 20 which eliminates necessity for a user to open/close the sheet feeding cassette 10 when the user prints few papers.

The sheet feeding cassette 10 and the manual feeding tray 20 are provided with the pickup rollers 16, which lead sheets to the covey route one by one.

A sheet conveyed from the sheet feeding cassette 10 is conveyed to the resist roller 14 via a convey roller 25-1 in the convey route, and conveyed to the transfer roller 11 at a timing that allows an end of the sheet to overlap with an end of image information on the intermediate transfer belt 7. Then, the image information is written onto the sheet. After that, the sheet passes through the fixing unit 12 so that unfixed toner on the sheet is fused/fixed onto the sheet by heat. Then, the sheet passes through a convey roller 25-2 and delivered onto the sheet delivery tray 15 via a sheet delivery roller 25-3 (in a case where one-sided printing is requested).

On the other hand, a sheet placed onto the manual feeding tray 20 is conveyed by a pickup roller 16-2, reaches the resist roller 14 via a plurality of convey rollers (25-6, 25-5, and 25-4), and delivered onto the sheet delivery tray 15 via the same subsequent processes as those of the sheet conveyed from the sheet feeding cassette 10 (in a case where one-sided printing is requested).

At that time, when two-sided printing is requested, a back-end of the sheet having been subject to one-sided printing and having passed through the fixing unit 12 as described above is held by the sheet delivery roller 25-3, and the sheet is conveyed to convey rollers (25-7 and 25-8) by inverse-rotation of the sheet delivery roller 25-3. Then, the sheet is subject to inverse printing via the resist roller 14, and is delivered to the sheet delivery tray 15.

(2) Developing Device

Next, the developing device that is a feature of the present invention is explained. The developing device is included in the image forming apparatus A based on the electrophotography as illustrated in FIGS. 12 and 13.

The developing device is used to supply toner to the photoconductor drums (latent image holders) 3.

Figure 1:
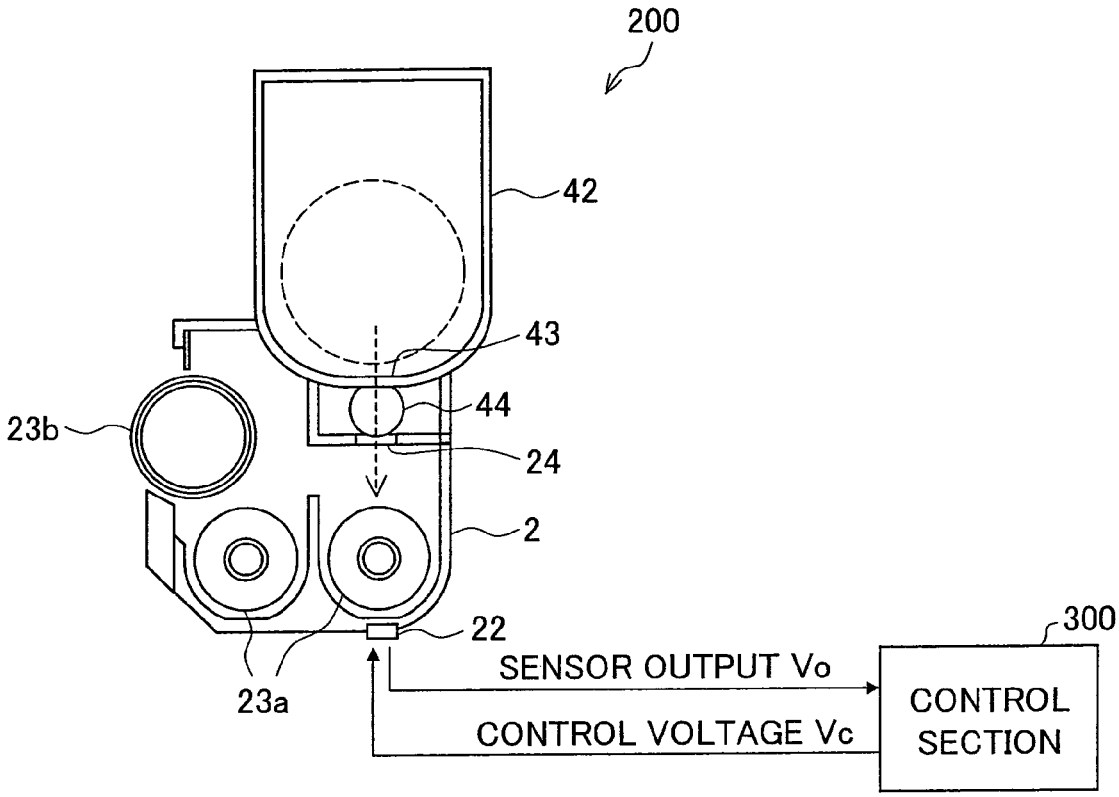
FIG. 1 is a cross sectional view illustrating a structure of a developing device according to the present invention.

FIG. 1 is a cross sectional view illustrating a developing device 200 of the present embodiment. The developing device 200 illustrated in FIG. 1 includes the developing tank 2 and the toner cartridge (toner supply section) 42. Note that the image forming apparatus A is capable of forming a color image and is provided with four colored image units. Therefore, the image forming apparatus A includes developing units corresponding to respective colors, each of the developing units being the developing device 200 in FIG. 1.

The developing tank 2 is a tank (toner tank) for containing two-component developer constituted of toner and carrier. The developing tank 2 supplies toner to the photoconductor drum 3. Further, toner density (ratio of toner to two-component developer; T/D) in the developing tank 2 is maintained in a constant value.

The developing tank 2 includes a stirring roller 23*a* for stirring two-component developer contained in the developing tank 2, a developing roller (developer carrying member) 23*b* for supplying toner to the photoconductor drum 3, and a toner density sensor 22 for detecting toner density in the developing tank 2.

The stirring roller 23*a* is provided at a bottom part of the developing tank 2. The stirring roller 23*a* stirs the two-component developer so that toner and carrier of the two-component developer are evenly mixed with each other and the toner is charged.

The developing roller 23*b* is a rotating roller having a round shape, and a part of the developing roller 23*b* is exposed at an opening part of the developing tank 2. The exposed part is disposed so as to be opposed to the photoconductor drum 3. The developing roller 23*b* carries the two-component developer contained in the developing tank 2 and conveys the two-component developer to the exposed part opposing to the photoconductor drum 3. As a result, it is possible to attach toner to an electrostatic latent image formed on the photoconductor drum 3. By developing the electrostatic latent image, a toner image can be formed.

Note that a rotating direction of the developing roller 23*b* is opposite to that of the photoconductor drum 3. Further, the developing roller 23*b* is rotated so as to be in contact with the photoconductor drum 3 while carrying toner.

Further, a rotation velocity of the developing roller 23*b* is set so that movement velocity of a surface of the developing roller 23*b* at a nip part between the developing roller 23*b* and the photoconductor drum 3 is equal to movement velocity of a surface of the photoconductor drum 3 at the nip part. Note that the movement velocity of the surface of the photoconductor drum 3 is equal to movement velocity of a sheet (recording paper), namely, process velocity of the image forming apparatus A.

Note that toner density is set to 5% in the developing device 200 in FIG. 1. The two-component developer contained in the developing tank 2 in the developing device 200 is not particularly limited. Toner density is not particularly limited and is generally set to 2 through 10%.

The toner density sensor 22 detects toner density in the developing tank 2 and manages the toner density so that the toner density has a constant value. The toner density sensor 22 detects magnetic permeability in the developing tank 2 and a result of the detection is outputted as a sensor output Vo. The toner density is calculated based on the sensor output Vo. The sensor output Vo is outputted to the control section 300 (such as a CPU) of the image forming apparatus A. The control section 300 can be regarded as a part of the developing device 200.

The toner cartridge 42 contains toner of the two-component developer. The toner cartridge 42 is disposed above the developing tank 2. When an amount of toner in the developing tank 2 drops, the toner cartridge 42 supplies toner contained in the toner cartridge 42 to the developing tank 2.

The two-component developer uses toner with no magnetism or low magnetism, and uses magnetic material as carrier. In the two-component developer, only toner is used for image forming such as printing. Therefore, only an amount of toner in the developing tank 2 drops as image forming processing progresses. Therefore, the value of the sensor output Vo of the toner density sensor 22 varies as the image forming processing progresses. For that reason, the developing device 200 is arranged so that toner is supplied from the toner cartridge 42 to the developing tank 2 when it is judged that toner density based on the sensor output Vo is less than a predetermined value (preset value).

To be specific, a toner supply roller 44 is disposed between a toner supply opening 43 of the toner cartridge 42 and a toner supply opening 24 of the developing tank 2. The toner supply roller 44 is made of a sponge roller for example. When toner is not supplied, the toner supply roller 44 serves as a cover of the toner supply openings 24 and 43. On the other hand, when toner is supplied, toner is supplied from the toner cartridge 42 to the developing tank 2 by rotation of the toner supply roller 44.

In this way, the toner density sensor 22 manages toner density in the developing tank 2 so that the toner density always maintains not less than a predetermined value.

The image forming apparatus A includes a plurality of printing modes having different stirring velocities as illustrated in Table 1 for example. As illustrated in Table 1, the image forming apparatus A for performing color printing includes (i) a normal printing mode in which color printing is performed, (ii) a high velocity printing mode in which monochrome (simple color) printing is performed, and (iii) a cardboard printing mode in which printing is performed onto a special paper such as a cardboard. Because of a difference in the stirring velocity, the modes are different from one another in terms of printing velocity, process velocity (movement velocity of a sheet), and the number of rotation of the photoconductor drum 3.

TABLE 1

| | PRINTING VELOCITY | PROCESS VELOCITY | NUMBER OF DRUM ROTATION |
|---|---|---|---|
| CARDBOARD PRINTING | 20 SHEETS/MINUTE | 83.5 mm/s | 26 rpm |
| NORMAL PRINTING | 35 SHEETS/MINUTE | 167 mm/s | 53 rpm |
| HIGH VELOCITY PRINTING | 45 SHEETS/MINUTE | 225 mm/s | 71 rpm |

Figure 7:
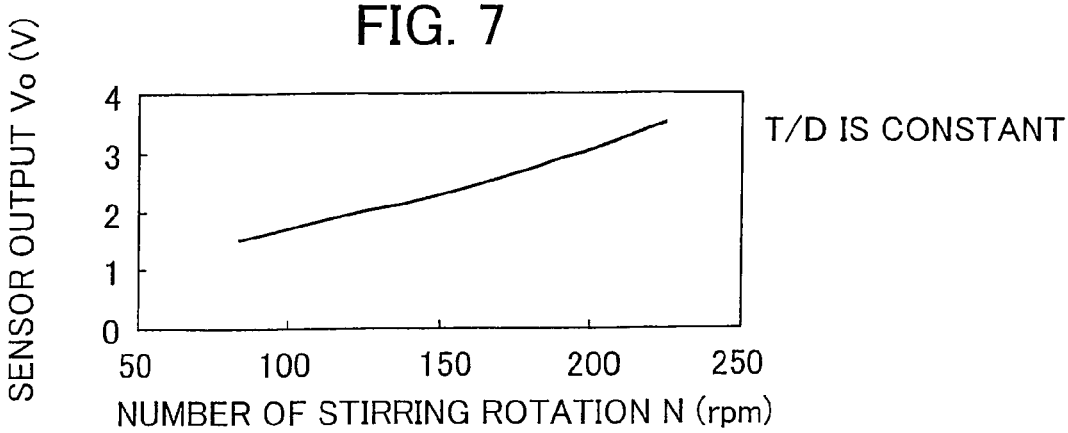
FIG. 7 is a graph illustrating a relation between stirring velocity and a sensor output of the toner density sensor when toner density has a constant value.
Figure 8:
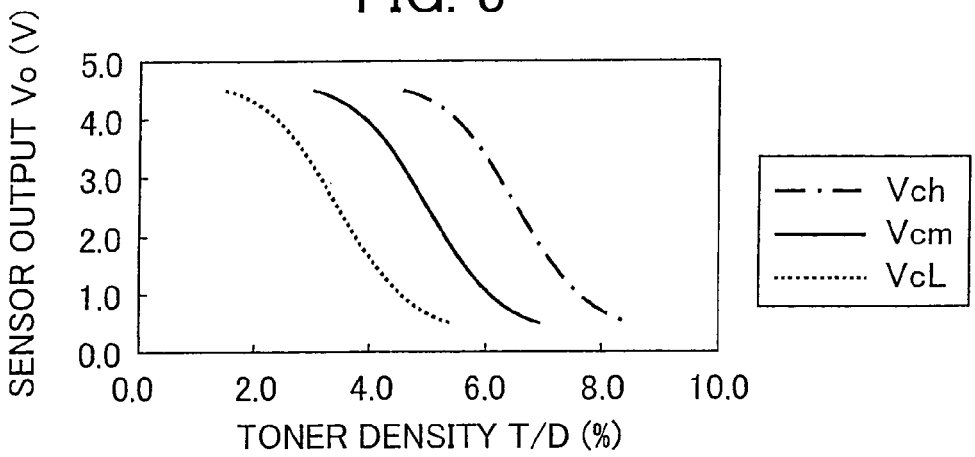
FIG. 8 is a graph illustrating a relation between the toner density and the sensor output according to a difference in stirring velocity.
Figure 9:
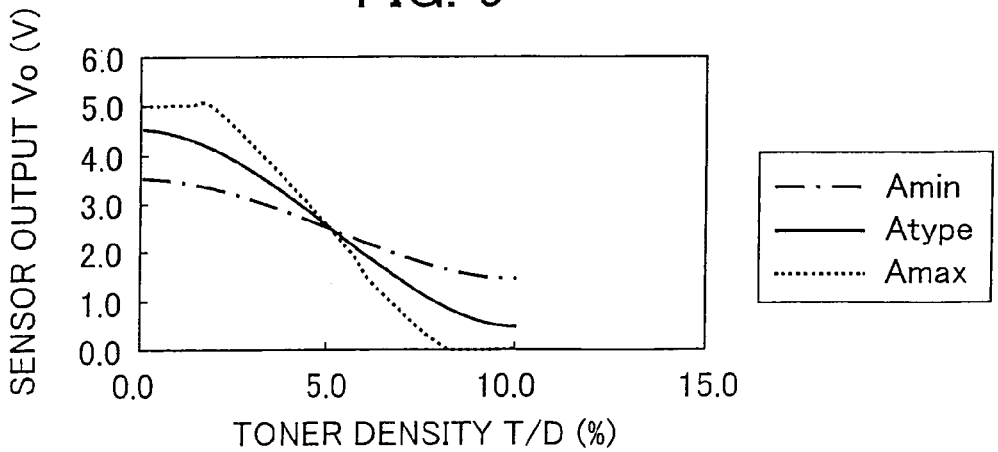
FIG. 9 is a graph illustrating a relation between the toner density and the sensor output of the toner density sensor according to a difference in the toner density sensor.

Here, the sensor output (Vo) of the toner density sensor 22 is greatly influenced by the stirring velocity of the developing tank 2 and humidity in the vicinity of the developing tank 2 (or the toner density sensor 22). This is because a difference in the stirring velocity or the humidity varies an amount of charge in the developing tank 2, resulting in variations of bulk density of the two-component developer. FIG. 7 is a graph illustrating a relation between the stirring velocity (number of stirring) and the sensor output of the toner density sensor 22 when toner density has a constant value. FIG. 8 is a graph illustrating a relation between toner density and a sensor output according to a difference in stirring velocities. FIG. 9 is a graph illustrating a relation between toner density and the sensor output of the toner density sensor 22 according to variations of the toner density sensor 22.

As illustrated in FIG. 7, the sensor output of the toner density sensor 22 increases with an increase in stirring velocity. As a result, even when toner density has a constant value, the sensor output of the toner density sensor 22 varies according to stirring velocity.

Further, as illustrated in FIG. 8, in a case where stirring velocity varies (Vch>Vcm>Vcl), when toner density has a constant value, the lower stirring velocity is, the lower sensor output is. Further, when a sensor output has a constant value, the lower stirring velocity is, the lower toner density is. In an S-shaped curve illustrated in FIG. 8, a central portion of the curve is substantially a straight line. This indicates that a change in a sensor output substantially linearly increases according to decrease of toner density. Namely, the central portion is a region where accuracy of detection by the toner density sensor 22 is high.

On the other hand, both ends of the curve have low linearity and a sensor output increases little even when toner density changes. Namely, both ends of the curve are regions where accuracy of detection by the toner density sensor 22 is low.

Further, as illustrated in FIG. 9, even when stirring velocity has a constant value, the sensor output varies between different toner density sensors 22. Namely, lot unevenness or production unevenness of the toner density sensor 22 cause values of the sensor outputs to be uneven.

In this way, the faster the stirring velocity is, the larger the sensor output is (FIG. 7). Further, the lower the toner density is, the larger the sensor output is (FIG. 8). Further, when the stirring velocity has a constant value, values of the sensor outputs are different between toner density sensors 22 (FIG. 9). Further, because the toner density sensor 22 detects magnetic permeability of two-component developer, the sensor output varies according to humidity.

Therefore, the developing device 200 according to the present embodiment is arranged so that a control voltage (Vc) for adjusting (correcting) a value of a sensor output of the toner density sensor 22 is inputted to the toner density sensor 22. The control voltage is set by the control section 300 and inputted to the toner density sensor 22. As a result, a sensor output corrected by the control voltage is outputted from the toner density sensor 22.

The developing device 200 according to the present embodiment is arranged so that the control voltage (Vc) is set with respect to each of the stirring velocities set in the image forming apparatus A. Further, the control voltage (Vc) is set in consideration of humidity in the vicinity of each of the developing tanks 2 (each of the toner density sensors 22). As a result, the toner density sensor 22 can increase a sensor output (output signal) according to decrease of toner density with respect to each stirring velocity. Note that humidity in the vicinity of each of the developing tanks 2 (each of the toner density sensors 22) is detected by a humidity sensor (not shown).

The control voltage (Vc) controls a sensor output so that a sensor output having high linearity and high detection accuracy is outputted. Note that the control voltage (Vc) is outputted to the toner density sensor 22 from, for example, the control section 300 (such as a CPU) of the image forming apparatus A.

Here, the control voltage (Vc) is detailed.

As described above, in the developing device 200 using two-component developer, only toner is consumed according to formation of an image, and toner whose amount corresponds to the amount of consumed toner is supplied. Therefore, toner density in the developing tank 2 continuously varies. As such, it is difficult to obtain accurate toner density while performing image forming processing.

On the other hand, when the developing tank 2 is shipped with two-component developer in the developer tank 2, the two-component developer solidifies in the developing tank 2. Therefore, a new developing tank 2 is shipped without any two-component developer. On this account, when the developing device 200 is set (when the developing device 200 is in initial condition), two-component developer is to be contained in the new developing tank 2. The two-component developer to be contained in the new developing tank 2 is ready-made developer that is produced so as to have predetermined toner density (standard toner density).

Therefore, the developing device 200 according to the present embodiment adjusts (corrects) the sensor output (sensor sensibility) of the toner density sensor 22 by using a standard control voltage being set by use of two-component developer with known toner density (two-component developer with standard toner density). Then, the standard control voltage is used as a standard value for adjusting (correcting) the sensor output in subsequently using the developing device 200, so as to obtain the control voltage (Vc). As a result, the toner density sensor 22 can output a sensor output (output signal) proportional to toner density with respect to each stirring velocity.

In this way, the developing device 200 according to the present embodiment sets a plurality of standard control voltages corresponding to a plurality of stirring velocities, and sets control voltages corresponding to stirring velocities by using the standard control voltages. As a result, it is possible to adjust (correct), based on stirring velocity at which a developing process is performed, the output of the toner density sensor 22 at the stirring velocity. Therefore, it is possible to set the toner density sensor 22 so that the toner density sensor 22 operates in the most suitable manner with respect to each of the stirring velocities, thereby realizing detection of toner density with high accuracy.

Figure 10:
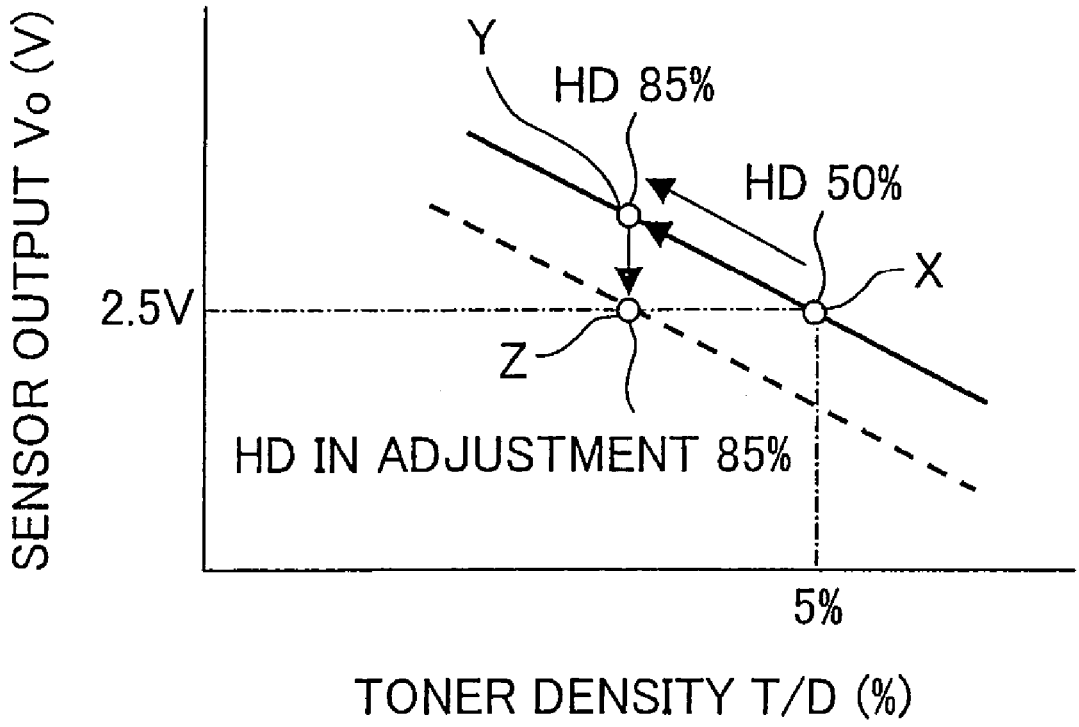
FIG. 10 is a graph illustrating a relation between the toner density and the sensor output of the toner density sensor according to a difference in humidity.

Note that when the control voltage is obtained without taking into account humidity in the vicinity of the developing tank 2 (in the vicinity of the toner density sensor 22), the sensor output does not correspond to the toner density, as with when stirring velocities are different from each other. FIG. 10 is a graph illustrating a relation between the toner density and the sensor output of the toner density sensor 22 according to a difference in humidity.

As illustrated by a point X on a full line in FIG. 10, it is assumed that: in setting the toner density sensor 22 at humidity (HD) 50%, the sensor output of the toner density sensor 22 that detects two-component developer whose toner density is 5% is adjusted to be 2.5V. At that time, when the toner density does not change and humidity becomes 85%, a sensor output that is larger than 2.5V as illustrated by a point Y on the full line should be outputted in consideration of a change in humidity. However, without taking into consideration the change in humidity, even when humidity changes, unless the toner density changes, the sensor output is 2.5V as illustrated by a point Z on a broken line in FIG. 10. As a result, the toner density is recognized to be higher than actual toner density.

Next, the following details a method for adjusting the toner density sensor 22 so as to obtain a control voltage. FIGS. 2 through 5 are flowcharts illustrating an example of procedures in adjusting the toner density sensor 22.

Figure 2:
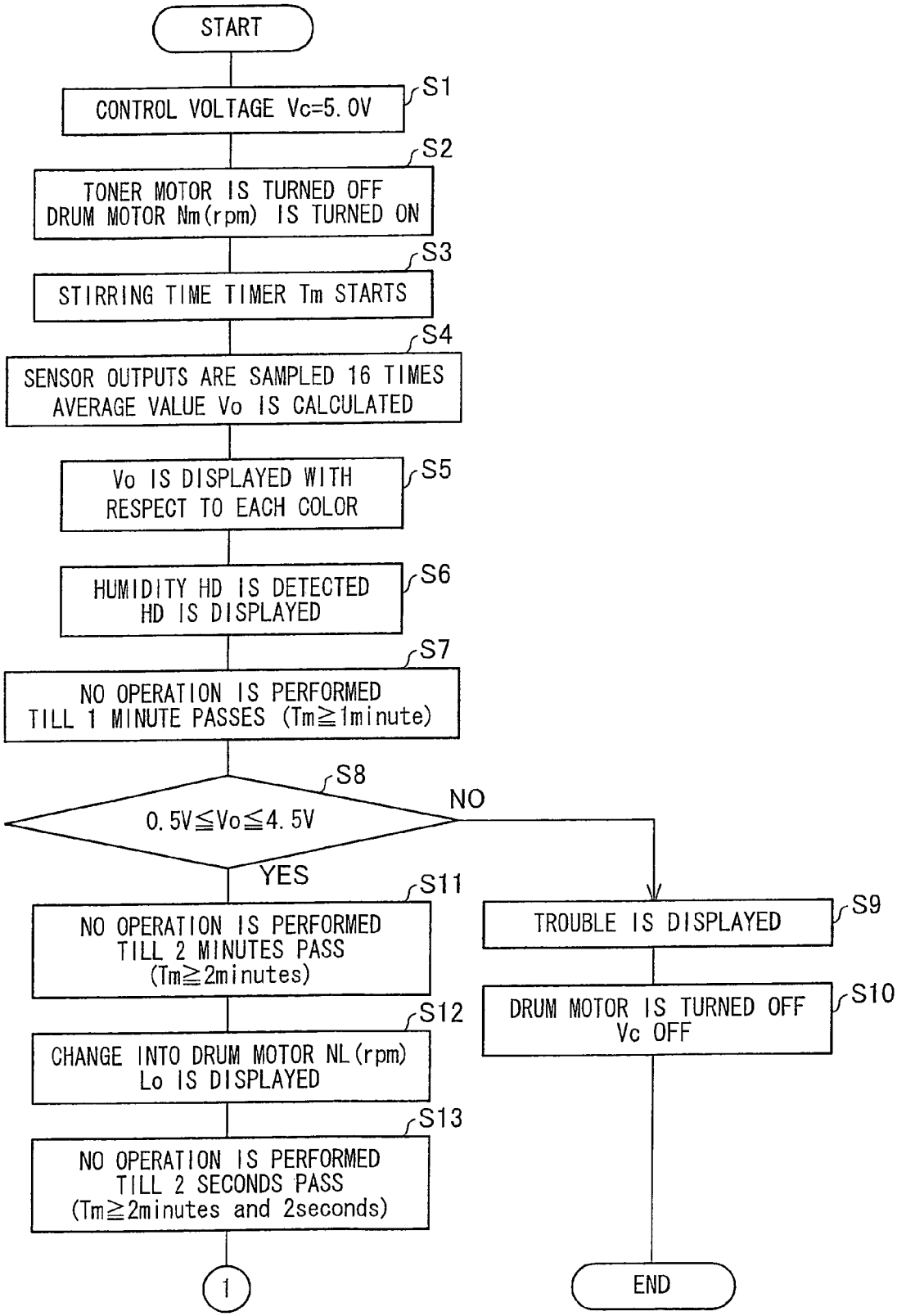
FIG. 2 is a flowchart illustrating procedure of an adjustment of a toner density sensor in the developing device according to the present invention.

As illustrated in FIG. 2, first, a control voltage (Vc) of the toner density sensor 22 in standard toner density (here, 5%) is set to a predetermined value (here, 5V) (step S1).

Next, a toner motor (motor for supplying toner) is turned OFF so that toner is not supplied to the developing tank 2, and then a drum motor of the photoconductor drum 3 is turned ON so as to be rotated at rotation velocity (Nm (rpm)) of normal printing. At that time, only two-component developer having been produced so as to have standard toner density (here, 5%) is contained in the developing tank 2 (step S2).

Because stirring in the developing tank 2 starts in accordance with turning the drum motor ON, a stirring time timer whose stirring time has been set to Tm starts simultaneously with turning the drum motor ON. The stirring is performed so that an amount of charge in two-component developer in the developing tank 2 is stabilized (step S3).

Next, an output value (sensor output) of the toner density sensor 22 at the stirring time Tm is detected. Because the sensor output has unevenness after the stirring has started, an average value of sensor outputs as many as 16 times is regarded as the sensor output (Vo) of the toner density sensor 22. Note that while sampling (here, for 1 minute), the value of the sensor output is always displayed on a display panel (display section). As a result, by observing the display panel, it is possible to confirm whether or not the amount of charge is stabilized (step S4).

The average value of the sensor outputs (Vo) is detected and displayed on the display panel (not shown) with respect to each color (step S5).

Next, humidity (HD) in the vicinity of the developing tank 2 (in the vicinity of the toner density sensor 22) is detected and a result of the detection is displayed on the display panel (step S6). Then, no operation is performed till 1 minute passes (step S7).

Next, it is determined whether or not the average value (Vo) of the sensor outputs of each color is within a range from 0.5V to 4.5V (step S8). Note that the range may be set arbitrarily within the range which allows for detection of a trouble of the toner density sensor 22. When the average value is out of the range, the toner density sensor 22 has a breakdown. Therefore, a trouble (trouble display) is displayed on the display panel (step S9), the drum motor and the control voltage (Vc) are turned OFF (step S10), and the processing is finished.

On the other hand, when the average value of the sensor outputs is within the range, two-component developer is further stirred for 2 minutes (step S11). Steps up to this step are processing for confirming the trouble of the toner density sensor 22.

Next, adjustment processing (setting of a standard control voltage) of the sensor output of the toner density sensor 22 is performed. First, rotation velocity of the drum motor in line with stirring velocity of the developing tank 2 is changed from the rotation velocity (Nm (rpm)) of the normal printing to a rotation velocity of cardboard printing whose velocity is lower than that of the normal printing. At that time, Lo indicative of low rotation velocity is displayed on the display panel (step S12). Next, after 2 seconds have passed, each driving system is stabilized (step S13).

Figure 3:
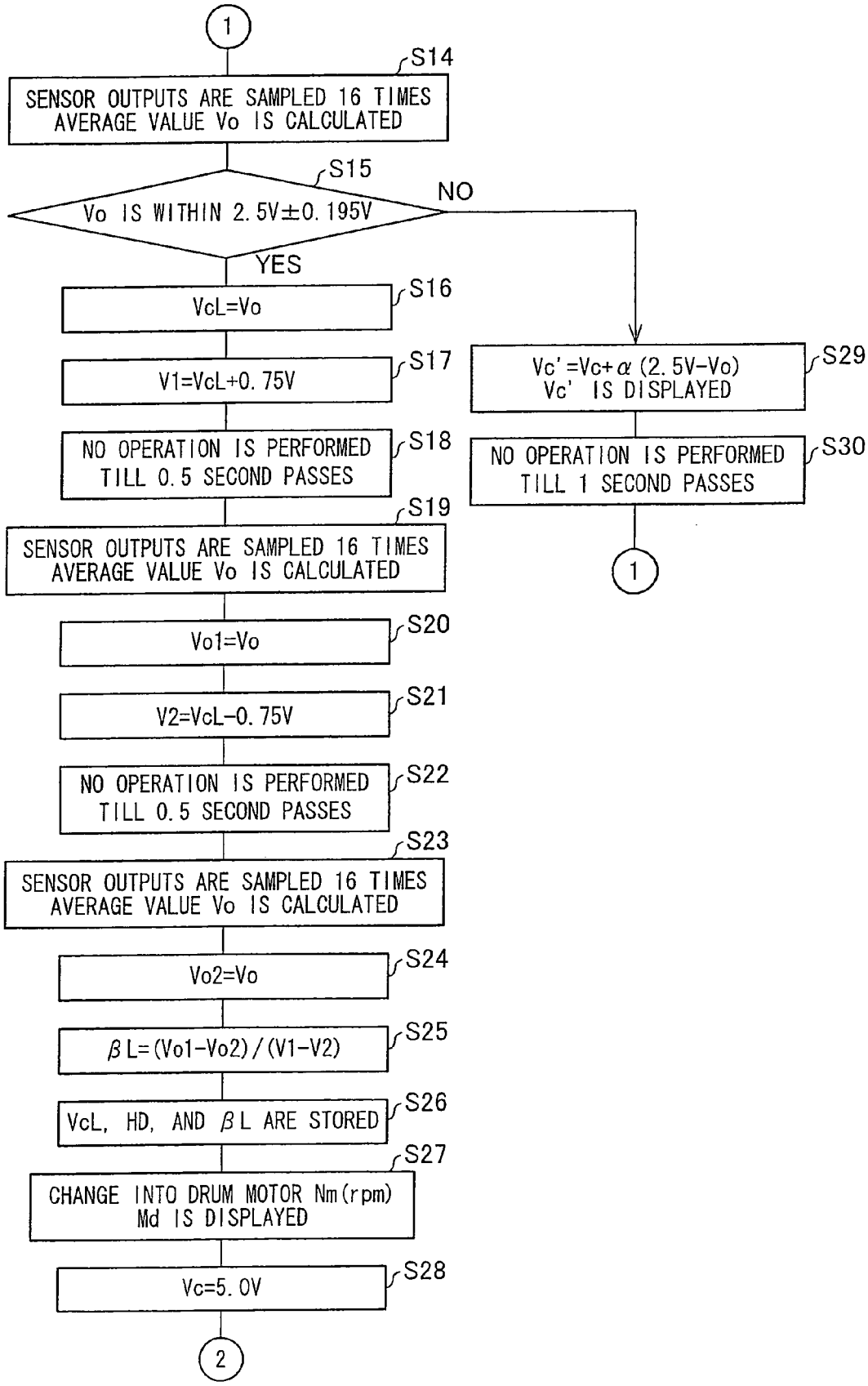
FIG. 3 is a flowchart illustrating procedure of an adjustment of the toner density sensor in the developing device according to the present invention.
Figure 4:
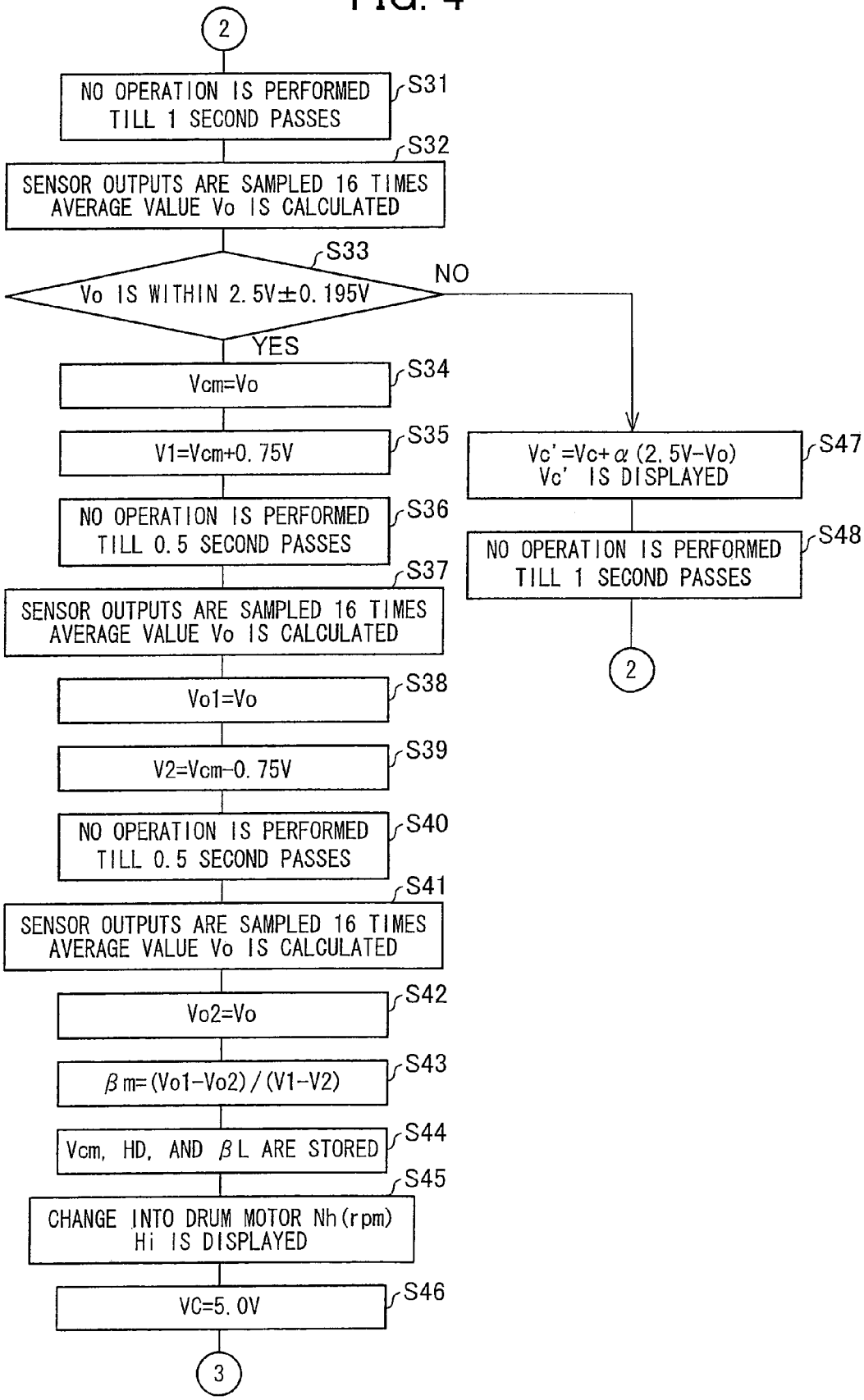
FIG. 4 is a flowchart illustrating procedure of an adjustment of the toner density sensor in the developing device according to the present invention.
Figure 5:
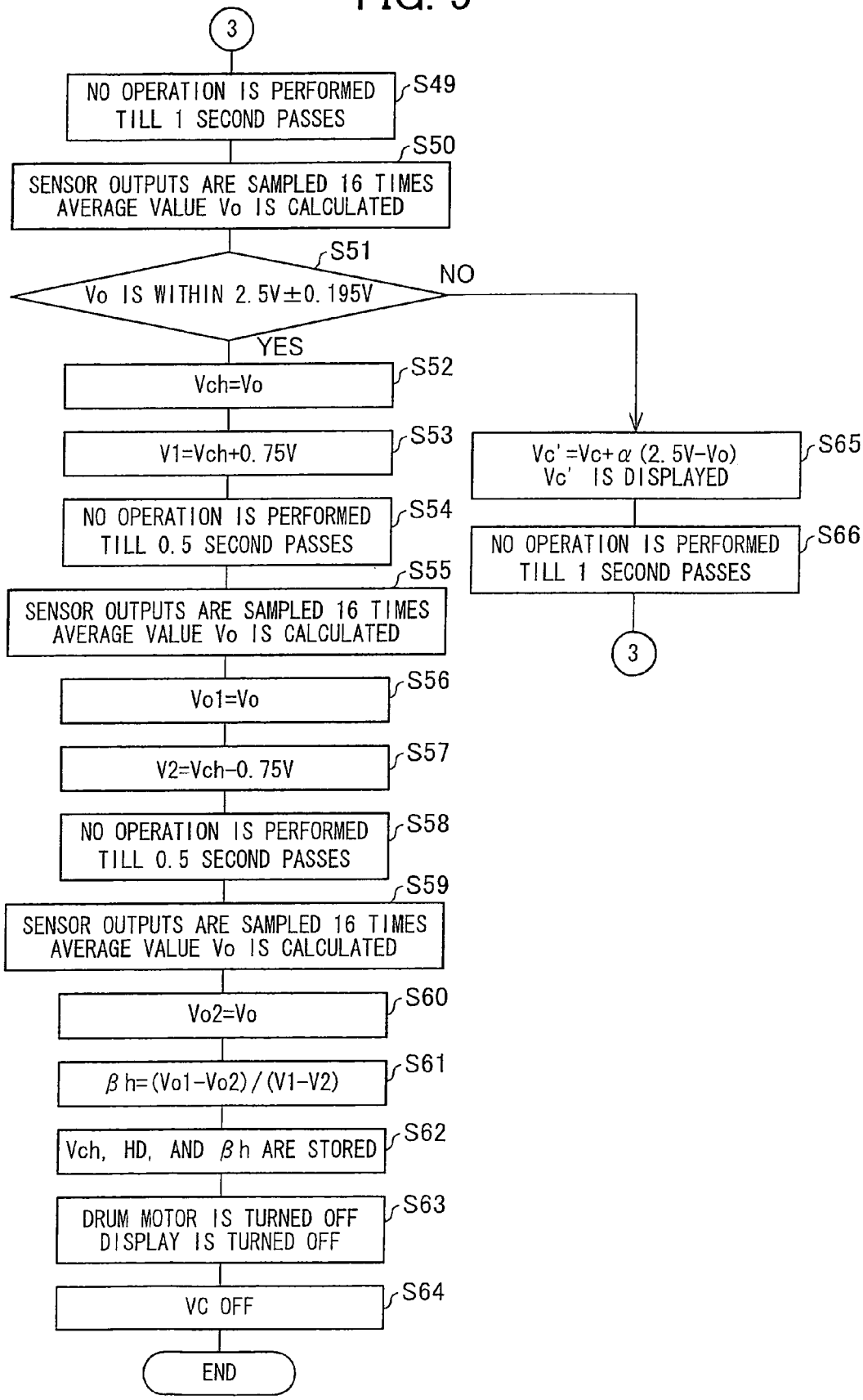
FIG. 5 is a flowchart illustrating procedure of an adjustment of the toner density sensor in the developing device according to the present invention.

Next, as illustrated in FIG. 3, as with the case of confirming a trouble as describe above, an average value of sensor outputs as many as 16 times in the cardboard printing (low velocity printing) is obtained, and regarded as the sensor output (Vo) of the toner density sensor 22 (step S14).

It is judged whether or not the average value (Vo) of the sensor output is within a predetermined range (here, 2.5±0.195V) (step S15).

When the average value (Vo) of the sensor outputs is within the range (YES in step S15), the average value (Vo) of the sensor output calculated in step S14 is regarded as a standard control voltage (VcL) in the cardboard printing (low velocity printing). The standard control voltage (VcL) is stored in a storage section such as a memory (step S16).

Next, a predetermined value (here, 0.75V) is added to the standard control voltage (VcL) so as to obtain a control voltage, which is regarded as V1 (step S17). After 1 second has passed, a sensor output of the toner density sensor 22 corresponding to the switched control voltage (V1) is stabilized (step S18). Note that it is preferable that the predetermined value in S17 is set so as to correspond to a part having high linearity in the graph of FIG. 8.

Next, an average value (Vo) of sensor outputs as many as 16 times in the switched control voltage (V1) is calculated (step S19) and the average value (Vo) is stored in the memory as a sensor output (Vo1) of the toner density sensor 22.

Next, as to a predetermined value (−0.75) having a sign opposite to that of the predetermined value in step S17, an average value (Vo2) of the sensor output of the toner density sensor 22 is obtained in the same way as steps S17 through 20 and stored in the memory (steps S21 through 24).

Next, by using the average values (Vo1 and Vo2) of the sensor outputs and the control voltages (Vc1 and Vc2), an inclination (βL) indicative of the sensor output of the toner density sensor 22 is obtained (step S25).

In this way, in steps S17 through 25, the inclination (βL) of the sensor output relative to a state in which the standard control voltage changes between two points whose center is the standard control voltage (VcL) is obtained.

Then, the center of the inclination (standard control voltage VcL), humidity (HD), and the inclination (βL) are stored in the memory (step S26). As a result, the processing of the standard control voltage (VcL) in the cardboard printing (low velocity printing) is completed.

Note that when the average value of the sensor outputs is out of the range in step S15 (NO in step S15), it is impossible to regard the average value (Vo) of the sensor output calculated in step S14 as the standard control voltage (VcL). On this account, it is necessary to correct (adjust) the control voltage (Vc) having been set in the first step (step S1). Therefore, processing for obtaining a new control voltage (corrected standard control voltage) is performed. Here, the new control voltage (Vc') is displayed as "Vc (the initial control voltage having been set in step S1)+α(2.5V−Vo)" on the display panel. Note that a is an arbitrary coefficient (step S29).

Next, after changing the average value (Vo) of the sensor output so as to obtain the new control voltage (Vc'), no operation is performed for 1 minute during which the new control voltage (Vc') is stabilized (step S30). After that, sampling (step S14) and judgment (step S15) are repeated so that the average value is within the scope specified in S15. Note that when steps S29 and S30 are performed, the standard control voltage (VcL) is the corrected standard control voltage (Vc'). However, for convenience of drawing, the standard control voltage (VcL) is illustrated as Vc.

Substantially the same processings as processings in the cardboard printing (steps S12 through S30) are performed in the normal printing (steps S27 through S44, S47, and S48) and high velocity printing (steps S45 and S46, S49 through S62). As a result, standard control voltages (Vch, Vcm, and VcL) calculated from two-component developer having standard toner density can be set with respect to each of the stirring velocities (Nh, Nm, and NL). The memory stores not only the standard control voltages (Vch, Vcm, and VcL) but also the humidity (HD) in setting each of the standard control voltages and each of the inclinations (βh, βm, and βL) of the sensor output relative to a state in which the standard control voltage changes between the two points whose center is each of the standard control voltages (Vch, Vcm, and VcL).

Then, the drum motor and the display panel are turned OFF (step S63), the control voltage (Vc) is turned OFF (step S64), and the processing is finished. Note that such processing is performed by, for example, a serviceman in setting the developing device 200.

Figure 6:
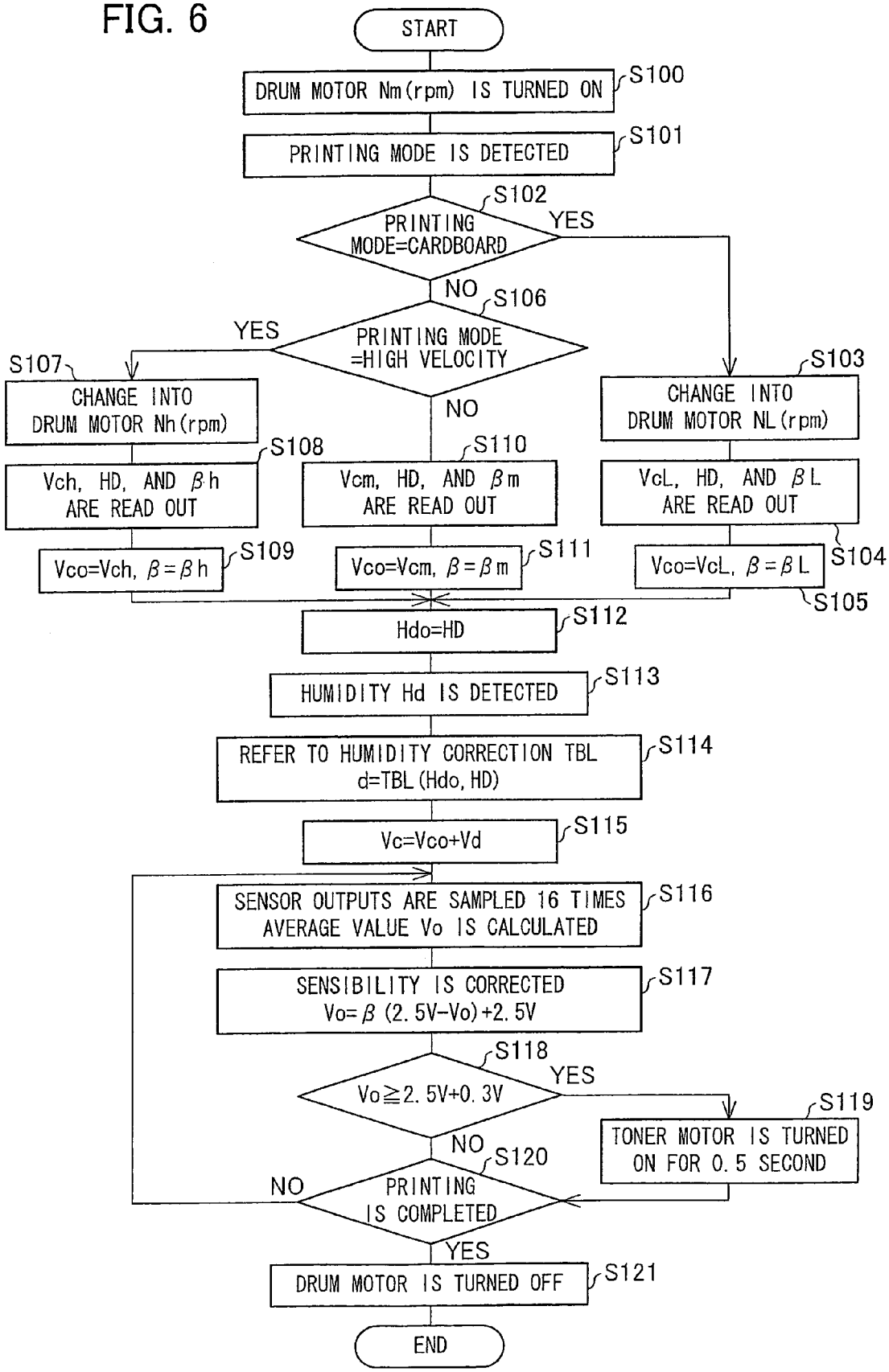
FIG. 6 is a flowchart illustrating printing procedure in an image forming apparatus including the developing device according to the present invention.

Next, printing processing of the image forming apparatus A including the developing device 200 is explained. FIG. 6 is a flowchart illustrating processing procedures of the image forming apparatus A. The image forming apparatus A sets a control voltage according to actual stirring velocity by using standard control voltages (Vch, Vcm, and VcL), humidity (HD), and inclinations (βh, βm, and βL) having been set with respect to each stirring velocity.

First, when printing starts, the drum motor is turned ON, and rotated in the normal printing Nm (rpm) (step S100).

Next, the printing mode is detected (step S101). First, it is determined whether or not the printing mode is the cardboard printing (step S102). Here, when the printing mode is the cardboard printing, the drum motor is rotated in the cardboard printing NL (rpm) (step S103). Then, the standard control voltage (VcL), the humidity (HD), and the inclination (βL) stored in the memory are read out (step S104). Then, the control voltage Vco of the cardboard printing is regarded as VcL, and the inclination β of the cardboard printing is regarded as βL.

In the same way, it is determined whether or not the printing mode is the high velocity printing (step S106). When the printing mode is the high velocity printing (YES in step S106), the number of rotation of the drum motor is changed, the standard control voltage (Vch), humidity (HD), and inclination (βh) stored in the memory are read out, and the control voltage Vco of the high velocity printing is regarded as Vch and inclination β of the high velocity printing is regarded as βh (steps S107 through 109). Further, when the printing mode is neither the cardboard printing nor the high velocity printing, the standard control voltage (Vcm), humidity (HD), and inclination (βm) stored in the memory are read out, and the control voltage Vco of the normal printing is regarded as Vcm and inclination β of the normal printing is regarded as βm (steps S110 through S1111).

Next, humidity in an initial adjustment (humidity in setting a standard control voltage) (HD) is read out from the memory and regarded as Hd0 (step S112).

Next, present humidity (Hd) is detected. Then, a corrected value of humidity (control voltage for correction of humidity) is obtained by using a humidity correction table. FIG. 11 illustrates an example of a humidity correction table. In FIG. 11, a lateral axis indicates relative humidity in the initial adjustment (see FIGS. 2 through 5) and a vertical axis indicates the present humidity (Hd). A cross point of the vertical axis and the lateral axis in the table is a control voltage for correcting humidity (Vd) (step S114).

Next, the correction value (Vd) read out from FIG. 11 is added to the control voltage in the initial adjustment (standard control voltage having been read out) (Vco) so as to obtain an actual control voltage (Vc) after correction (step S115).

In this way, the corrected control voltage is determined and outputted to the toner density sensor 22.

Next, the average value (Vo) of the sensor outputs after inputting the corrected control voltage is calculated from samplings performed as many as 16 times (step S116).

Further, sensibility of the sensor output (Vo) of the toner density sensor 22 is corrected (step S117). Here, correction is performed by using a control voltage whose value is β(2.5V−Vo)+2.5V. This 2.5V is a central of the two points used in obtaining the inclination (β). Further, "(2.5V−Vo)+2.5V" is the corrected value of the inclination (β). It is possible to keep the inclination of the sensor output constant by using the corrected value. Namely, even when stirring velocity is different, it is possible to keep the inclination of the sensor output constant. As a result, it is possible to correct unevenness (unevenness of sensibility) of the sensor output of each toner density sensor 22. Note that the corrected value of the inclination (β) can be changed arbitrarily.

Next, it is determined whether or not the sensor output (Vo) after correcting the sensibility is not less than a predetermined range (here, not less than 2.5V+0.3V; note that the values can be set arbitrarily) (step S118). In step S118, when the sensor output (Vo) after correction of sensibility is not less than the range, toner is in short. Therefore, toner is supplied by the toner motor (step S119). Further, when the sensor output is within the range, this condition is acceptable. Therefore, toner is not supplied.

Then, completion of printing (completion of all printing jobs) is confirmed (step S120). The processing (steps S116 through 120) is repeated until completion of printing. When printing is completed, the drum motor is turned OFF (step S121) and the processing is finished. Toner density changes according to image forming processing. Therefore, by repeating the processing, constant check of toner density is possible. Therefore, it is possible to set the toner density sensor 22 so that the toner density sensor 22 operates in the most suitable manner with respect to each of the stirring velocities (printing modes), thereby realizing detection of toner density with high accuracy in a wide range.

Note that in the above explanation, the toner density sensor 22 is adjusted so that toner density is 5%. However, the developing device 200 may be arranged so that a plurality of toner densities can be changed according to a plurality of developing modes (printing modes). For example, it is assumed that the developing device 200 includes a normal mode in which toner density is set to 5% and a toner save mode in which toner density is set to 4%. In this case, the control section 300 obtains not only a control voltage (Vcn)

which causes a sensor output to be 2.5V (standard control voltage) for the normal mode, but also a control voltage (Vce) which causes the sensor output to be 2.0V (standard control voltage) for the toner save mode. In the normal mode, the control voltage is set to (Vcn) and toner supply is controlled so that the sensor output is 2.5V. In the toner save mode, the control voltage is set to (Vce) and toner supply is controlled so that the sensor output is 2.0V. As a result, it is possible to control toner density so that the toner density is 5% in the normal mode, and to control toner density so that the toner density is 4% in the toner save mode. Therefore, for example, even when the developing device 200 includes the toner save mode for reducing consumption of toner, it is possible to set the toner density sensor 22 so that the toner density sensor 22 operates in the most suitable manner by switching setting values of a toner density range.

Note that the control section 300 of the developing device 200 may be realized by hardware logic or may be realized by causing a CPU to execute software.

Namely, the developing device 200 includes: a CPU (central processing unit) for carrying out a command of a control program for realizing functions; a ROM (read only memory) that stores the program; a RAM (random access memory) that develops the program; a storage device (storage medium) such as a memory for storing the program and various data items; and the like. The object of the present invention also can be realized in such a manner that the developing device 200 is provided with a computer-readable storage medium for storing a program code (such as an executable program, an intermediate code program, and a source program) of a control program of the developing device 200 which program serves as software for realizing the functions, and the computer (alternatively, CPU or MPU) reads out and executes the program code stored in the storage medium.

The storage medium is, for example, tapes such as a magnetic tape and a cassette tape, or discs such as magnetic discs (e.g. a floppy disc (registered trademark) and a hard disc), and optical discs (e.g. a CD-ROM, a MO, a MD, a DVD, and a CD-R). Further, the storage medium may be cards such as an IC card and an optical card, or semiconductor memories such as a mask ROM, an EPROM, an EEPROM, and a flash ROM.

Further, the present invention may be arranged so that the developing device 200 is capable of connecting with a communication network and the program code is supplied to the developing device 200 via the communication network. The communication network is not particularly limited. Examples of the communication network include the Internet, an intranet, an extranet, a LAN, an ISDN, a VAN, a CATV communication network, a virtual private network, a telephone line network, a mobile phone communication network, a satellite communication network. Further, a transmission medium that constitutes the communication network is not particularly limited. Examples of the transmission medium include (i) wired lines such as IEEE 1394, a USB, a power line carrier, a cable TV line, a telephone line, and an ADSL line and (ii) wireless such as an infrared ray (e.g. IrDA or remote controller), Bluetooth (registered trademark), 802.11 wireless, HDR, a portable phone network, a satellite line, and a terrestrial wave digital network. Note that the present invention can be realized by using a computer data signal embedded in a carrier wave, which is the program code that is electrically transmitted.

As described above, the developing device according to the present invention includes: a developing tank for containing two-component developer including toner and carrier and for stirring the two-component developer at a plurality of stirring velocities; a toner density sensor for detecting toner density in the developing tank; a toner supply section for supplying toner to the developing tank; and a control section for inputting, to the toner density sensor, a control voltage for correcting a sensor output that is outputted from the toner density sensor, wherein the control section sets a standard control voltage for correcting a sensor output obtained by sensing density of two-component developer having standard toner density having been set to a certain value so that the sensor output corresponds to each of the stirring velocities, and the control section sets the control voltage by use of the standard control voltage so that the sensor output has a value within a range indicative of predetermined toner density so as to correspond to each of the stirring velocities.

It is preferable that the developing device according to the present invention includes a developing unit including the developing tank, the toner density sensor, and the toner supply section, said developing unit being provided so as to correspond to each of a plurality of two-component developers having different colors.

With the arrangement, the developing device includes a developing unit having at least the developing tank, the toner density sensor, and the toner supply section, so as to correspond to each of the plurality of developers for performing color printing. As a result, with respect to each developing unit, it is possible to set the toner density sensor so that the toner density sensor operates in the most suitable manner with respect to each of stirring velocities, thereby realizing detection of toner density with high accuracy.

Note that a developing device for color printing (color developing device) has a plurality of modes such as a high velocity mode (monochrome mode), a normal mode (color mode), and a low velocity mode (mode for special papers such as cardboards) and accordingly a range of stirring velocity of the developing tank is wide. Therefore, with the arrangement, it is possible to realize a particularly prominent effect.

It is preferable that: in the developing device, the control section is capable of switching ranges (setting values) of the predetermined toner density in accordance with a plurality of developing modes.

Some of the developing devices have not only the plurality of stirring velocities but also different setting values of toner densities corresponding to a plurality of developing modes. With the arrangement, it is possible to switch ranges of the predetermined toner density according to the developing modes having different setting values of toner density. As a result, when setting values of ranges of toner density are switched, it is possible to set the toner density sensor so that the toner density sensor operates in the most suitable manner, thereby realizing detection of toner density with high accuracy.

It is preferable that: the developing device further includes a humidity sensor for detecting humidity in the vicinity of the developing tank or the toner density sensor and the control section corrects the standard control voltage and the control voltage in accordance with a result of detection carried out by the humidity sensor.

Humidity as well as the stirring velocity in the developing tank causes a change in an amount of charge of two-component developer and a change in apparent bulk density. With the arrangement, the control section corrects the standard control voltage and the control voltage based on the result of detection of the humidity sensor. As a result, it is possible to set the control voltage by using humidity in setting the standard control voltage and humidity at a time when the developing device actually operates. Therefore, it is possible to correct the standard control voltage and the control voltage based on humidity, thereby realizing detection of toner density with high accuracy.

It is preferable that: in the developing device, the control section sets the control voltage by using an inclination of the sensor output or a corrected value of the inclination which is relative to a state in which the standard control voltage changes between at least two points whose center is the standard control voltage.

In the developing device, the sensor output values are uneven due to lot unevenness or product unevenness of the toner density sensors. With the arrangement, the control section sets the inclination of the sensor output or the corrected value of the inclination by using a change in at least two standard control voltages whose center is the standard control voltage. The control voltage is set using the corrected value. As a result, it is possible to correct unevenness (unevenness of sensibility) of the sensor output of each of the toner density sensors.

It is preferable that: the developing device includes a display section for displaying at least one of the stirring velocity, the sensor output, the standard control voltage, the control voltage, and an image of a developing tank in setting the control voltage.

With the arrangement, the display section displays information used to adjust (correct) the toner density sensor (sensor output). As a result, it is possible for a serviceman to adjust (correct) the toner density sensor (sensor output) while checking the display section. Therefore, the serviceman can grasp progress of adjustment and a trouble of the toner density sensor (e.g. the sensor output or the control voltage does not stabilize (converge)).

As described above, the image forming apparatus according to the present invention includes the developing device having any of the foregoing arrangements. As a result, the image forming apparatus can realize effects caused by the developing device.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The developing device according to the present invention is particularly applicable to a color printing device (color image forming apparatus) based on the electrophotography.

What is claimed is:

1. A developing device, comprising:

a developing tank configured to contain two-component developer including toner and carrier and to stir the two-component developer at a plurality of stirring velocities;

a toner density sensor configured to detect toner density in the developing tank;

a toner supply section configured to supply toner to the developing tank; and a control section configured to input, to the toner density sensor, a control voltage for correcting a sensor output that is outputted from the toner density sensor, wherein the control section is configured to set a standard control voltage for correcting a sensor output obtained by sensing density of two-component developer having standard toner density having been set to a certain value so that the sensor output corresponds to each of the stirring velocities, and the control section is configured to set the control voltage by use of the standard control voltage so that the sensor output has a value within a range indicative of predetermined toner density so as to correspond to each of the stirring velocities.

2. The developing device as set forth in claim 1, comprising a developing unit including the developing tank, the toner density sensor, and the toner supply section, said developing unit being provided so as to correspond to each of a plurality of two-component developers having different colors.

3. The developing device as set forth in claim 1, wherein the control section is capable of switching ranges of the predetermined toner density in accordance with a plurality of developing modes.

4. The developing device as set forth in claim 1, further comprising a humidity sensor configured to detect humidity in a vicinity of the developing tank or the toner density sensor, wherein the control section is configured to correct the standard control voltage and the control voltage in accordance with a result of detection carried out by the humidity sensor.

5. The developing device as set forth in claim 1, wherein the control section is configured to set the control voltage by using an inclination of the sensor output or a corrected value of the inclination which is relative to a state in which the standard control voltage changes between at least two points whose center is the standard control voltage.

6. The developing device as set forth in claim 1, comprising a display section configured to display at least one of the stirring velocity, the sensor output, the standard control voltage, the control voltage, and a state of a developing tank in setting the control voltage.

7. An image forming apparatus, comprising the developing device as set forth in claim 1.

8. A control method for controlling a developing device that includes: a developing tank for containing two-component developer including toner and carrier and for stirring the two-component developer at a plurality of stirring velocities; a toner density sensor for detecting toner density in the developing tank; and a toner supply section for supplying toner to the developing tank, said method comprising a control step for inputting, to the toner density sensor, a control voltage for correcting a sensor output that is outputted from the toner density sensor, said control step including the sub-steps of:

setting a standard control voltage for correcting a sensor output obtained by sensing density of two-component developer having standard toner density having been set to a certain value so that the sensor output corresponds to each of the stirring velocities; and setting the control voltage by use of the standard control voltage so that the sensor output has a value within a range indicative of predetermined toner density so as to correspond to each of the stirring velocities.

9. A computer-readable storage medium for storing a control program, which is executed in conjunction with operation of developing device, the developing device comprising:

a developing tank for containing two-component developer including toner and carrier and for stirring the two-component developer at a plurality of stirring velocities;

a toner density sensor for detecting toner density in the developing tank;

a toner supply section for supplying toner to the developing tank, and a control section comprising a computer which executes the control program, the control program, when executed, performing the actions of:

setting a standard control voltage for correcting sensor output obtained by sensing density of the two-component developer having standard toner density having been set to a certain value so that the sensor output corresponds to each of the stirring velocities; and setting the control voltage by use of the standard control voltage so that the sensor output has a value within a range indicative of predetermined toner density so as to correspond to each of the stirring velocities.

10. A developing device, comprising:

a developing tank configured to contain two-component developer including toner and carrier and to stir the two-component developer at a plurality of stirring velocities;

a toner density sensor configured to detect toner density in the developing tank;

a toner supply section configured to supply toner to the developing tank; and a control section configured to input, to the toner density sensor, a control voltage for correcting a sensor output that is outputted from the toner density sensor, wherein the control section is configured to set a standard control voltage for correcting a sensor output obtained by sensing density of two-component developer having standard toner density having been set to a predetermined value so that the sensor output corresponds to each of the stirring velocities, and the control section is configured to set, based on a sensor output in receiving the standard control voltage having been set, the control voltage so that a ratio of a change in the sensor output relative to a change in the toner density is constant and the control voltage corresponds to each of the plurality of stirring velocities.

* * * * *